United States Patent [19]

Schwartz et al.

[11] 4,432,081

[45] Feb. 14, 1984

[54] QUICK DATE SETTING BY PUSH-BUTTON IN A WATCH

[75] Inventors: Herbert Schwartz, Wurmberg, Fed. Rep. of Germany; Jean P. Skwarek, Besancon, France

[73] Assignee: Timex Corporation, Waterbury, Conn.

[21] Appl. No.: 323,204

[22] Filed: Nov. 20, 1981

[30] Foreign Application Priority Data

Dec. 11, 1980 [DE] Fed. Rep. of Germany ..... 3032871
Dec. 11, 1980 [DE] Fed. Rep. of Germany ..... 3046569

[51] Int. Cl.[3] ..... G04B 27/00
[52] U.S. Cl. ..... 368/35; 368/221
[58] Field of Search ..... 368/35, 36, 37, 38, 368/221

[56] References Cited

U.S. PATENT DOCUMENTS

| | | | |
|---|---|---|---|
| 3,892,067 | 7/1975 | Meylan-Piguet | 368/36 |
| 4,027,468 | 6/1977 | Felty et al. | 368/35 |
| 4,291,397 | 9/1981 | Wuthrich et al. | 368/35 |

*Primary Examiner*—Forester W. Isen
*Attorney, Agent, or Firm*—William C. Crutcher

[57] ABSTRACT

An improvement in a date indexing device for an analog watch using manual indexing of a date ring with a push button. The indexing member indexes the date ring with a pawl guided onto the toothed rim of the date while one of the driving gear elements for the date ring is disengaged by moving an elastically yieldable support for the gear element.

13 Claims, 3 Drawing Figures

QUICK DATE SETTING BY PUSH-BUTTON IN A WATCH

BACKGROUND OF THE INVENTION

This invention relates to a date indexing device for an analog (hands) watch with a rotatable date indication carrier or "date ring," which has at least one toothed rim for the purpose of its indexing, and with a driving gear between the motor of the watch and the data ring, as well as a setting member for the manual indexing of the date ring.

With conventional analog watches, whether these have a mechanical or an electric motor, it is always troublesome and time-consuming to have manually to index the date ring at the end of a month with less than 31 days since in most cases, with the aid of the watch's crown, the hands must also be adjusted. If, however, a quick-setting procedure is provided (cf. e.g. U.S. Pat. No. 3,413,800 or U.S. Pat. No. 4,291,397), with the aid of which the date ring is adjustable without the hands of the watch being moved, two problems arise. Firstly, any damage to the watch's gearing upon actuation of the quick-setting device must be prevented and, secondly, the date ring should not be able to readjust itself inadvertently if the watch is subjected to any shocks. These two problems have not so far been satisfactorily solved.

The object of the invention was, therefore, to develop a date indexing device for an analog watch, with which the date ring is indexable quickly and simply without adjusting the hands, but without there being any danger of the date ring being inadvertently readjusted when subjected to the normal shocks which occur during use of the watch. Based on a date indexing device of the type mentioned at the beginning the object is resolved according to the invention by designing the setting member as a push button which operates an indexing pawl for indexing the date ring and by the driving gear having a gear element, which is disengageable when the push button is actuated. Firstly, the date ring is indexable directly, i.e. without adjustment of the hands, and in a simple manner; secondly, the danger of the watch's gearing being damaged when a correction is made to the position of the date ring is eliminated by the disengageable gear element. Finally, as the date ring is always connected with the driving gear when the push button mentioned is in its rest position it is as good as ruled out that an incorrect positioning of the date indication carrier will result if the watch is subjected to the shocks which occur during use.

In order to be absolutely certain that actuation of said push button during the time period including midnight, during which the date ring is indexed, does not lead to the watch being damaged it is advisable to have merely one spring, which operates the quick-setting procedure, tensioned by this push button; this spring then accomplishes the indexing of the date ring; for this purpose one preferred embodiment of the date indexing procedure according to the invention is provided with a spring tensionable by the push button; the date ring is indexable by the indexing pawl during the return stroke of this spring. In the case under consideration the spring merely assists the automatic indexing of the date ring.

In order that the quick-setting procedure according to the invention does not lead to a burden on the watch's motor and, therefore, to an unnecessary expenditure of energy it is also advisable for the indexing pawl, in its rest position, to be free of the toothed rim of the date indication carrier.

One particularly advantageous embodiment is provided with a driving gear designed as a self-blocking, toothed indexing gear for the normal activation of the date ring. Thus no stop spring, or the like, dissipating energy is required to secure the date ring when indexing is not in process since the driving gear takes over this function. This sort of driving gear is often generally designated (strictly speaking incorrectly) Geneva driving gear although this driving gear represents only one special instance of this self-blocking, toothed indexing gear.

The simplest way of achieving disengagement of a gear element, which serves the normal indexing of the date ring, when actuating the quick-setting procedure, is by providing the disengageable gear element with a support elastically yieldable for disengagement. If the position of the date indication carrier is corrected by actuation of the push button mentioned, the gear element, which is disengageable and formed in particular as a pinion, will, if the device is designed accordingly, lift automatically out of the teeth of the next gear element under the effect of the torque exerted by the date ring and jump over one, or if necessary several, teeth where it will be re-engaged at the end of the quick-setting procedure under the influence of the elastic return forces. On the other hand, the elastic return forces for the disengageable gear element are quite easily selectable such that the driving gear can still reliably prevent the date ring from uncontrollably readjusting itself under the influence of the shocks which occur when using the watch.

If the disengageable gear element is held in its engaged position by spring tension it is to be recommended that a stop, which is operative in the direction of engagement, be provided for the movement of the bearing in order to prevent the disengageable gear element being forced against the adjacent gear element by the spring tension—this would impair the easy action of the driving gear and expend energy unnecessarily. Such a stop also permits an increase in the spring tension, which serves to secure the date ring and affects the disengageable gear element, without impairing the easy action of the driving gear.

SUMMARY OF THE INVENTION

Briefly stated, the invention comprises an improvement in a date indexing device for an analog watch with a rotatable date ring, which has at least one toothed rim for the purpose of its indexing, with a driving gear train between the motor of the watch and the date ring as well as a setting member for the manual indexing of the date ring, whereby the improvement comprises a setting member designed as a push button operating an indexing pawl for indexing the date ring and the driving gear has a gear element, this being disengageable when the push button is actuated.

In the case of a particularly simple embodiment of the construction according to the invention the disengageable gear element is designed as a pinion mounted on a lever sprung for engagement of the gear element; when the setting member is in its rest position the lever abuts resiliently against the said stop.

In the case of a preferred embodiment of the device according to the invention the self-blocking, toothed indexing gear is designed such that it has a pinion which is connected with an indexing segment having a circular curve, that the disengageable gear element, which is designed as a pinion, rests with its teeth against the circular curve of the indexing segment and the latter has at least one indexing tooth projecting radially beyond the circular curve as well as a recess on each side of this indexing tooth for making room for the teeth of the pinion located on each side of indexing tooth. If the pinion connected with the indexing segment is actuated such that it makes one revolution in 24 hours the indexing segment is then provided with a single indexing tooth to index the date indication carrier once every day. The construction may also, of course, be designed such that the indexing segment has, for example, two indexing teeth and the pinion connected with it is operated such that it makes one revolution in 48 hours. The self-blocking function of the driving gear will be brought about by the fact that the pinion forming the disengageable gear element rests with two of its teeth against the circular curve of the indexing segment. In order to make the action of the driving gear as easy as possible a stop is recommended which will normally keep the teeth of the disengageable pinion at a small distance from the said circular curve; this distance must, of course, be so small that the disengageable pinion can turn only if it is either lifted out of the indexing segment or the indexing tooth of the indexing segment moves past it.

When applying the invention to a watch with DAY/-DATE indication a particularly simple construction results from the fact that two indexing segments, arranged one on each side of a pinion, are provided, the indexing teeth of which are offset relative to each other in a circumferential direction, and that the second indexing segment drives a pinion for indexing a day indication carrier. The offsetting of the indexing teeth of the indexing segments relative to each other permits the date and day indications to be indexed at the same time even if the pinions interacting with the two indexing segments are, for reasons of space, attached to axes placed side by side.

With such a construction it is particularly advisable to mount the lever with the bearing for the disengageable pinion on the stationary axis of the pinion for the day indication carrier.

In order to be absolutely certain, with the construction according to the invention, that an inadvertent readjustment of the date indication carrier does not occur when this is subjected to shocks the disengageable gear element is, for one embodiment of the invention, blocked in respect of its disengageability when the setting member is in its rest position. The simplest way of achieving this is for the setting member or part coupled with it to have a stop, operative only when the setting member is in its rest position, for blocking the said lever in its rest position.

So that the indexing pawl cannot have a restraining effect during normal indexing of the date indication carrier it is recommended that the indexing pawl be provided with a special track or "coulisse" which is designed such that the indexing pawl is lifted out of the toothed rim of the date indication carrier on its return stroke.

DRAWINGS

Additional features, advantages and details of the invention are given in the attached claims and/or in the following specification and the attached drawings of two particularly advantageous embodiments of the date indexing device according to the invention when used for a wrist-watch; the drawings show:

FIG. 1 a plan view of the so-called date plate of an electric, analog wrist-watch equipped according to the invention with the parts essential to the construction according to the invention with, however, part of the date ring forming the date indication carrier and the day disc forming the day indication carrier removed;

FIG. 2 a section through the date plate with the date indexing device according to the invention; and FIG. 3 an illustration corresponding to FIG. 1 showing a second embodiment of the date indexing device according to the invention.

DESCRIPTION OF THE PREFERRED EMBODIMENT

Figure 1:
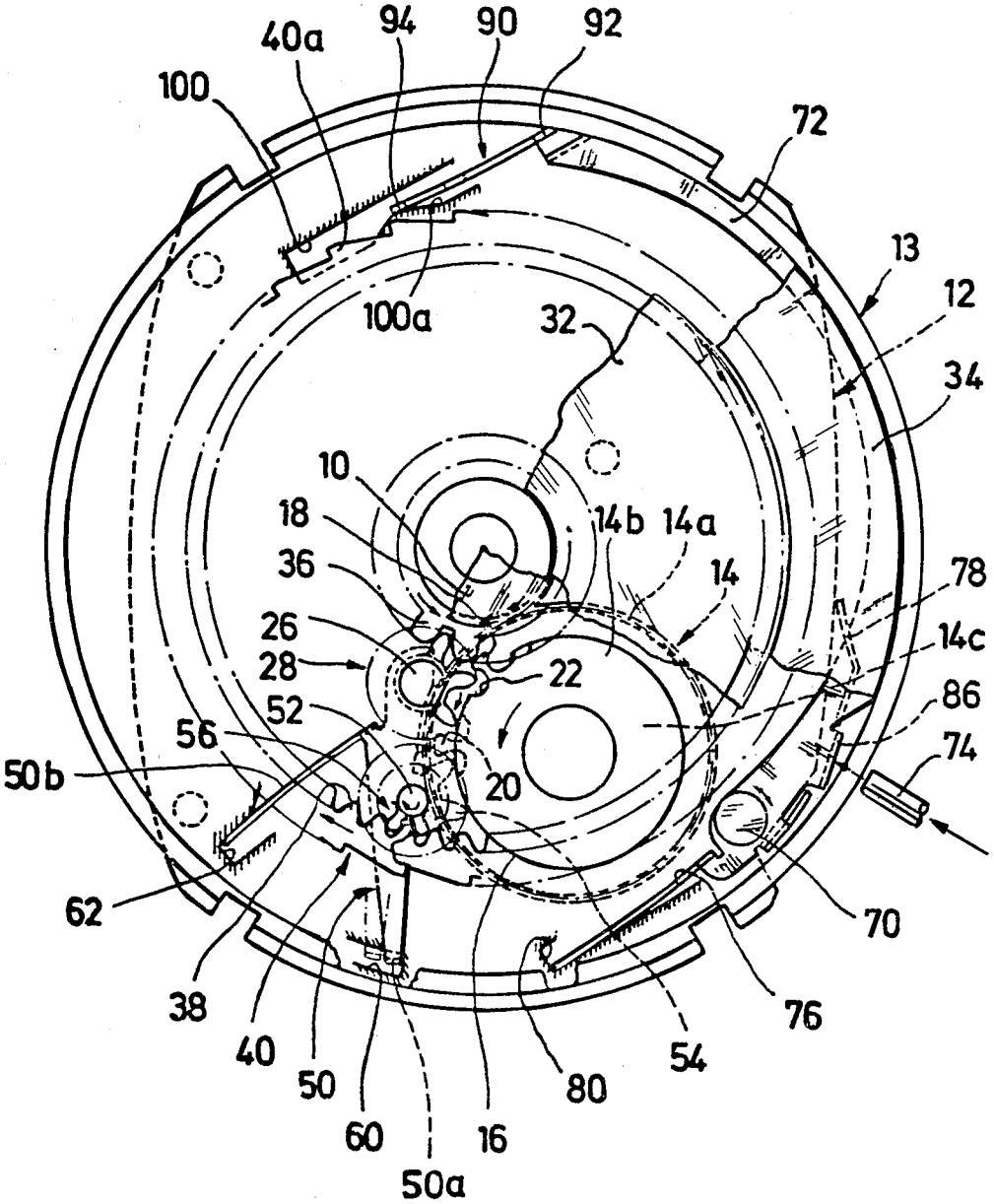
Figure 2:
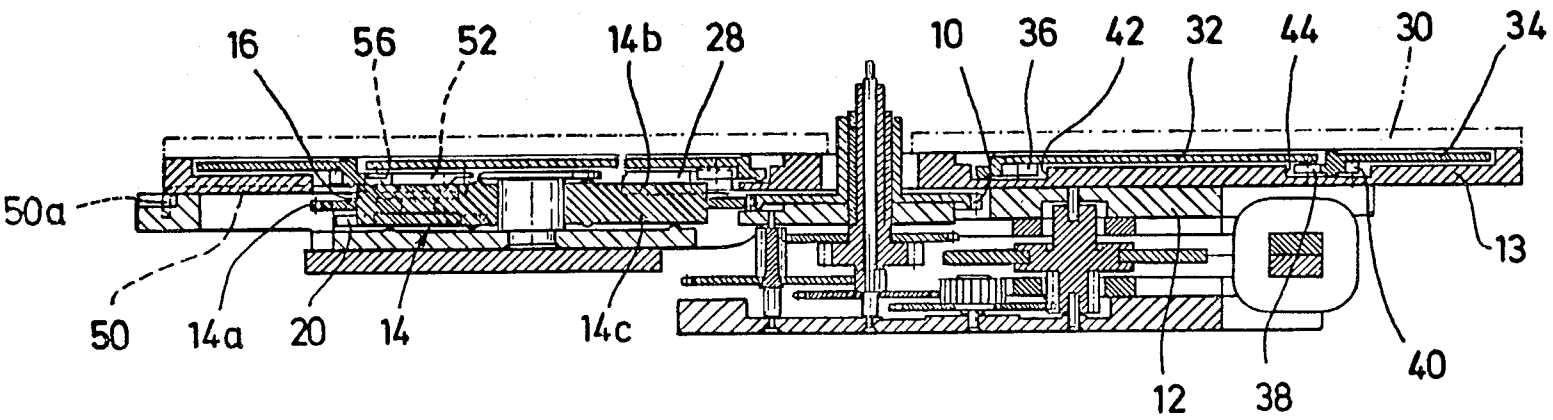

FIGS. 1 and 2 show an hour wheel 10 of the watch which drives a date indexing wheel 14 rotatably mounted on a frame plate 12. This wheel has, according to the invention, a pinion segment **14*a* meshing with the hour wheel 10, a day indexing segment 14*b* disposed on top and a date indexing segment 14*c* provided on the underside, these being advantageously formed by one single structural member, in particular an injection-moulded plastic part. The teeth of the hour wheel 10 and the pinion segment 14*a* are, in the embodiment drawn, coordinated with each other in such a way that the date indexing wheel 14** makes one revolution in 24 hours.

Each of the indexing segments **14*b*, 14*c* has essentially the form of a circular disc with a circular, circumferential area 16, which is not, however, completely closed since each of these indexing segments has an indexing tooth, i.e. the indexing tooth 18 on the upper side of the date indexing wheel 14 and the indexing tooth 20 on the underside. The circumferential area of each indexing segment has a recess 22 on both sides of each indexing tooth as FIG. 1 clearly illustrates. It should be added that the circular, circumferential area 16 runs concentrically to the axis of the date indexing wheel 14**.

In addition, an axis 26 is rotated mounted on the frame plate 12, a pinion, i.e. the day pinion 28, being attached to its upper end. This interacts with the day indexing segment **14*b* such that it is blocked each day over a period of, for example, 21 or 22 hours by the circular, circumferential area 16 of the day indexing segment 14*b* as in each case two of its teeth end at a very slight distance from this circular, circumferential area 16 whereas the day pinion 28 will be moved forward two teeth during the time period from shortly before to shortly after midnight due to the passing of the indexing tooth 18 and the recess 22** which follows it.

As shown in FIG. 2 the elements for the DAY/-DATE indication are disposed between a date plate 13 set on the frame plate 12 and a dial 30 which is merely indicated; these elements are a day disc 32 and a date ring 34, both running concentrically to the axis of the hour wheel 10. As usual, the upper side of the day disc 32 is marked at equal, angular distances with the abbreviations for the 7 days of the week (Mon-Sun) while the date ring 34 has the numbers "1" to "31" on its upper side, also at equal, angular distances. One of the abbreviations for the days of the week and one of the numbers is then visible through windows in the dial 30, which are not depicted. The day disc 32 is provided on its underside with a toothed rim 36, which also runs concentrically to the axis of the hour wheel 10 and the teeth of which point radially outwards, while the date ring 34 has two toothed rims, i.e. a first toothed rim 38, which is provided on the inner edge of the date ring and the teeth of which point radially inwards, as well as a second toothed rim 40 on the underside of the date ring, the teeth of which are formed according to the invention as saw teeth and point radially outwards. Notches 42 and 44 on the upper side of the date plate 13, which are in the form of a circular ring and concentric to the axis of the hour wheel 10, serve to secure the day disc 32 and the date ring 34 against radial displacement.

The day pinion 28 now meshes with the toothed rim 36 of the day disc 32 and since this toothed rim has 14 teeth and the day pinion 28 is, as mentioned, moved forward two teeth every 24 hours the day disc 32 makes one revolution each week about the axis of the hour wheel 10.

A lever 50 is hinged with its one end on axis 26 between date plate 13 and day pinion 28, an axis 52 is rotatably mounted approximately in the middle of this lever, a date indexing pinion 54 being fixed to the top end of this axis, a date driving pinion 56 to its bottom end. The date indexing pinion 54 interacts with the date indexing segment 14*c* in the same way as the day pinion 28 with the day indexing segment 14*b* so that it is moved forward two teeth every 24 hours whereas it is normally not turnable outside the indexing period around midnight due to the circular, circumferential area on the date indexing segment 14*c*. So that the day indication and the date indication are indexable at the same time the angular distance, according to the invention, of the indexing teeth 18 and 20 from each other corresponds to the angular distance of the axes 26 and 52 from each other relative to the axis of the date indexing wheel 14.

The date driving pinion 56 rotating with the date indexing pinion 54 meshes with the first, inner toothed rim 38 of the date ring 34. This has 62 teeth and since it is moved forward two teeth every 24 hours it completes one full revolution within 31 days provided that date indexing pinion 54 and date driving pinion 56 have the same number of teeth.

According to the invention, the gear pinions 54, 56 are rotatably mounted on lever 50 which serves as a support. The outer end of lever 50 is bent downwards at 50*a* to form a stop and, in addition, the lever 50 has a tongue 50*b*, which is bent downwards and forms one piece with it, this tongue having the function of a spring. A window 60 or 62 respectively is provided for both the stop 50*a* and the tongue 50*b*; the dimensions have been chosen such that the tongue 50*b* is biased against the left-hand edge of the window 62 if the stop 50*a*, as shown in FIG. 1, rests against the right-hand edge of window 60. The tongue 50*b*, which forms a leaf spring, therefore attempts constantly to swivel the lever 50 and the axis 26 counterclockwise and to press the date indexing pinion 54 against the date indexing segment 54*c*. In the same way as the slight distance between the teeth of the day pinion 28 and the circular, circumferential area 16 of the day indexing segment 14has been provided by the location of the axis 26 the stop 50*a* of the lever 50 guarantees, according to the invention, together with the right-hand edge of the window 60 a slight distance between the teeth of the date indexing pinion 54 and the circular, circumferential area 16 of the date indexing segment 14*c*. Although the day pinion 28 and the date indexing pinion 54 are accordingly blocked by the date indexing wheel 14 outside the indexing periods they are nevertheless unable to impair the easy action of the driving gear of the watch due to frictional losses.

It should be added that the normal direction of rotation for all parts is shown in FIG. 1 by means of arrows.

Finally, a quick-setting lever 72 is fitted rotatably to the frame plate 12 with the help of a pivot 70; this lever may be swiveled contrary to the effect of return springs 76 and 78 according to FIG. 1 in a counterclockwise direction around the pivot 70 by a push button 74, which is movable in the direction of the arrow within the watch casing, which is not shown, and is secured against dropping out. According to the invention the quick-setting lever 72 consists of a spring material so that the return springs 76 and 78, which are formed as leaf springs, may be an integral part of the quick-setting lever and have been simply manufactured by bending embossed, integral tongues downwards through 90°. While a window 80 is provided for the return spring 76 in the date plate 13 the return spring 78 is braced against the outer edge of the frame plate 12. So that a reliable surface for engagement of the push button 74 is available on the quick-setting lever 72 a lug 86 has been bent downwards out of its plane; the push button 74 will, when actuated, press against the lug's surface, which points radially outwards. As according to the invention two return springs are available for resetting the quick-setting lever 72 and the push button 74, these return springs being simply manufactured by punching out and bending, a sufficient amount of return force is quaranteed.

The free end of the quick-setting lever 72 is formed according to the invention as an indexing pawl formed as a resilient hook 90. In the case of the preferred embodiment shown, the sheet metal used in the manufacture of the quick-setting lever has been bent downwards at 92 in accordance with FIG. 1 in order to create a leaf spring, which is flexibly movable in the plane of the drawing. The free end of the pawl 90 is provided with a nose 94 projecting upwards.

According to the invention the date plate 12 has a window 100 shown in FIG. 1, one edge of which forms a track or "coulisse" 100*a* for the hook 90 of the quick-setting lever 72; the quick-setting lever 72 has been formed such that the front end of its hook 90 is constantly and lightly biased against the coulisse 100*a* and the nose 94 passes so far through the window 100 that it ends in the plane of the second toothed rim 40 of the date ring 34. Furthermore, the coulisse 100*a* is, according to the invention, formed such that it holds the hook 90, in the rest position of the quick-setting lever 72 (cf. FIG. 1), away from the teeth of the toothed rim 40 but releases the next tooth of this toothed rim to be engaged by the hook 90; this tooth has been labelled 40*a* in FIG. 1. With the preferred embodiment of the date indexing device according to the invention, as shown, the front end of the hook 90, when the push button 74 is actuated, slides first of all inwards along the slant of the coulisse 100*a* in the direction of the sloping side of the tooth 40*a* and then reaches behind the upright side of the tooth 40*a* in the course of the continued rotating motion of the quick-setting lever. As the return springs 76 and 78 have at the same time been tensioned or more strongly tensioned they will, when the push button 74 is released, pull the hook 90 in accordance with FIG. 1 to the right. This hook then rotates the date ring 34 in a clockwise direction in accordance with FIG. 1 until the front end of the hook is pushed radially outwards by the slant of coulisse 100*a* and lifted out of the toothed rim 40. With the embodiment shown the toothed rim 40 is intended to have 31 teeth so that the quick-setting lever 72 always moves the date ring 34 forward one tooth. The stroke of the quick-setting lever 72 could just as well extend over two teeth of a toothed rim having 62 teeth. The described design and function of the flexible hook 90 and the coulisse 100*a* have the advantage that the quick-setting lever 72 in its rest position does not impede the date ring 34 and, consequently, its indexing by the watch's motor does not expend more energy than is absolutely necessary.

So that the position of the date ring 34 can actually be corrected with the aid of the quick-setting lever 72, even though the date indexing wheel 14 blocks the date indexing pinion 54 and, therefore, the date driving pinion 56, which meshes with the toothed rim 38 of the date ring 34, outside the normal indexing period around midnight, the construction according to the invention has been designed such that the lever 50, contrary to the effect of the spring tongue 50*b*, may be deflected by the date ring 34 moving in a clockwise direction: When the date ring 34 starts to move in a clockwise direction the date indexing pinion 54 also tries to rotate in a clockwise direction; it thereby braces itself against the circular, circumferential area 16 of the date indexing segment 14*c* with the one of its two teeth adjacent to this circular, circumferential area 16, which is nearer to the axis 26. This results in the lever 50 swiveling clockwise around axis 26 in accordance with FIG. 1; the lever 50 is rotated for so long until the date indexing pinion 54 can be turned. As each indexing of the date ring 34 by the one tooth of the toothed rim 40 corresponds to a rotation of the date indexing pinion 54 by two teeth the date indexing pinion 54 will consequently jump forward two teeth when the position of the date ring 34 is corrcted by one day.

As a relatively large return force of the spring tongue 50*b* can be selected with respect to the stop 50*a* of the lever 50—it has to be overcome only by the force of the return springs 76 and 78 when the quick-setting lever 72 is actuated—the construction according to the invention guarantees with the resilient bearing of the date indexing pinion 54 that the date ring 34 will be well secured against any uncontrolled rotation in a clockwise direction under the influence of any shocks, to which the watch is subjected. In accordance with a further feature of the invention the date ring 34 is also secured against any uncontrolled movement in a counterclockwise direction resulting from any shocks, to which the watch is subjected, due to the relative location to each other, as shown in FIG. 1, of the place of engagement of the date driving pinion 56 in the toothed rim 38 of the date ring 34, the axis 52 and the tooth of the date indexing pinion 54, which is adjacent to the circular, circumferential area 16 of the date indexing segment 14*c* but turned away from the axis 26; as a result of this relative layout the lever 50 cannot be swiveled in a clockwise direction if the date ring 34 tries to turn itself in a counterclockwise direction.

If the push button 72 is actuated during the indexing period around midnight the quick-setting lever 72 will, during its return stroke accomplished by spring tension, merely assist in the normal indexing by the date indexing wheel 14. Any damage to the watch is, therefore, ruled out.

The date ring 34 is, according to the invention, a one-piece aluminium part, which has been processed first of all by turning, then by press-molding and then, if necessary, if turning again and finally anodized to reduce friction and to prevent a galvanic corrosion aluminium/brass due to adjacent brass parts.

Instead of the two toothed rims 38 and 40 the date ring could have only one single toothed rim, which interacts with the pinion 56 as well as with the quick-setting lever 72, with, for example, the latter reaching inwards beyond the date ring to be able to interact with the teeth of the date ring pointing radially inwards. If this then has, for example, 62 teeth the stroke of the quick-setting lever must be chosen large enough for this to jump over one tooth when the push button 74 is pressed or the push button will have to be actuated twice.

MODIFICATION

Figure 3:
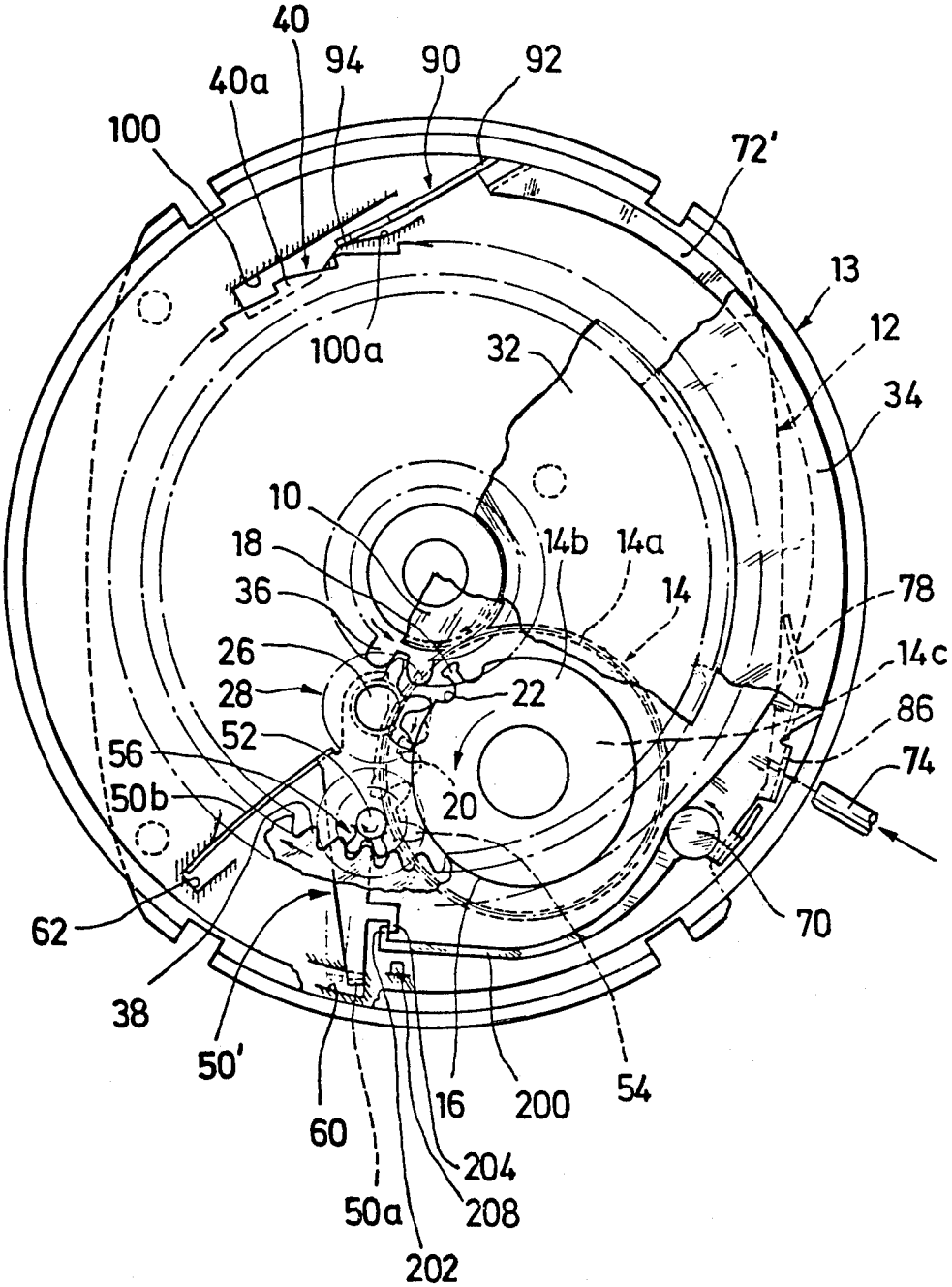

FIG. 3 is intended to show a variant of the embodiment of the invention explained in FIGS. 1 and 2. This variant differs from the embodiment described first of all only in the fact that the lever 50 is locked in position when the push button 74 is in its rest position.

The quick-setting lever 72', which corresponds to the quick-setting lever 72 of the first embodiment, is designed according to the invention as a two-armed lever and has an arm 200 with a locking nose 202, which reaches behind a locking nose 204 of the lever 50', which corresponds to lever 50 of the first embodiment, when both parts are in their rest position, i.e. when the push button 74 not depicted in FIG. 3 is in its rest position. With this embodiment no torque on the date ring 34 however large and caused by shocks can lead to an undesired adjustment of the date indication since the lever 50' is not rotatable at all and, therefore, the date indexing pinion 54 cannot be lifted off the date indexing wheel 14.

According to the invention a stop 208 is provided for the arm 200 of the quick-setting lever 72' on the date plate 13 or the frame plate 12 so that the arm is formed resiliently and can be used as an additional return spring element.

Of course, it is also within the framework of the invention if the date ring itself is not directly indexed but an element coupled with it. In this—more complicated—case the term "date ring" is to be replaced in the claims as well as in the above, general specification of the invention by "a gear element coupled with the date ring."

I claim:

1. An improvement in a date indexing device for an analog watch with a rotatable date ring, which has at least one toothed rim for the purpose of its indexing, with a driving gear train between the motor of the watch and the date ring as well as a setting member for the manual indexing of the date ring, wherein the improvement comprises a setting member designed as a push button operating an indexing pawl for indexing the date ring and the driving gear train has a disengageable gear element, said disengageable gear element comprising a self-blocking, toothed indexing gear element adapted to be disengaged only when the push button is actuated.

2. Improvement according to claim 1, further including a spring tensionable by the push button and wherein the date ring is indexable by the indexing pawl during the return stroke of this spring.

3. Improvement according to claim 2, wherein the force of the spring tensioned by the push button is sufficient to bring the disengageable gear element into its disengaged position.

4. Improvement according to claim 1, wherein the indexing pawl in its rest position has a free end which is free of the toothed rim of the date ring.

5. Improvement according to claim 4, further including a coulisse provided for the indexing pawl, the coulisse being designed such that the indexing pawl, during its return stroke, is lifted out of the toothed rim of the date ring.

6. Improvement according to claim 1, and further including a support, said disengageable gear element being mounted on said support, the support being elastically yieldable for disengagement.

7. Improvement according to claim 6, wherein said support includes a stop for limiting the movement of the support in the direction of engagement.

8. Improvement according to claim 7 wherein the disengageable gear element is designed as a pinion mounted on a lever sprung for engagement of the gear element.

9. Improvement according to claim 8, wherein with the setting member in its rest position the lever abuts resiliently against the stop.

10. Improvement according to claim 1, and further including in the driving gear train, a pinion which is connected with an indexing segment having a circular curve arranged such that the disengageable gear element, designed as a pinion, rests with its teeth against the circular curve of the indexing segment and that the latter has at least one indexing tooth projecting radially beyond the circular curve, and defining a recess on each side of this indexing tooth making room for the teeth of the pinion located on either side of the indexing tooth.

11. Improvement according to claim 10, wherein the pinion connected with the indexing segment also meshes with the hour wheel of the watch.

12. Improvement according to claim 10, wherein the disengageable gear element is sprung in the direction of the indexing segment.

13. Improvement according to claim 10, wherein the disengageable gear element is blocked in respect of its disengageability when the setting member is in its rest position.

* * * * *